US005346258A

United States Patent [19]

Behm et al.

[11] Patent Number: 5,346,258

[45] Date of Patent: Sep. 13, 1994

[54] GAME TICKET CONFUSION PATTERNS

[75] Inventors: William F. Behm, Marietta, Ga.; Stanley Litman, Gilrov; Bradly W. Walton, San Jose, both of Calif.

[73] Assignee: Scientific Games, Inc., Alpharetta, Ga.

[21] Appl. No.: 4,157

[22] Filed: Jan. 13, 1993

Related U.S. Application Data

[63] Continuation-in-part of Ser. No. 879,827, May 7, 1992, abandoned.

[51] Int. Cl.[5] ..... B42D 15/00

[52] U.S. Cl. ..... 283/102

[58] Field of Search ..... 283/95, 96, 102, 903

[56] References Cited

U.S. PATENT DOCUMENTS

| | | | |
|---|---|---|---|
| 2,986,820 | 6/1961 | Neville et al. . | |
| 3,055,117 | 9/1962 | Bernstein et al. . | |
| 3,877,155 | 4/1975 | Royka et al. . | |
| 3,900,219 | 8/1975 | D'Amato et al. . | |
| 3,930,673 | 1/1976 | Sanden . | |
| 3,938,993 | 2/1976 | Royka et al. . | |
| 3,940,124 | 2/1976 | Johnsen . | |
| 3,945,870 | 3/1976 | Johnsen . | |
| 3,956,049 | 5/1976 | Johnsen | 156/200 |
| 4,012,268 | 3/1977 | Johnsen . | |
| 4,025,673 | 5/1977 | Reinnagel . | |
| 4,033,611 | 7/1977 | Johnsen . | |
| 4,074,911 | 2/1978 | Stipek, Jr. . | |
| 4,095,824 | 6/1978 | Bachman . | |
| 4,099,721 | 7/1978 | Logander . | |
| 4,120,445 | 10/1978 | Carrier et al. . | |
| 4,174,857 | 11/1979 | Koza . | |
| 4,191,376 | 3/1980 | Goldman et al. . | |
| 4,241,942 | 12/1980 | Bachman . | |
| 4,273,362 | 6/1981 | Carrier et al. . | |
| 4,299,637 | 11/1981 | Oberdeck et al. . | |
| 4,398,708 | 8/1983 | Goldman et al. . | |
| 4,407,443 | 10/1983 | McCorkle . | |
| 4,457,430 | 7/1984 | Darling et al. . | |
| 4,488,646 | 12/1984 | McCorkle . | |
| 4,536,218 | 8/1985 | Ganho . | |
| 4,540,628 | 9/1985 | Oberdeck et al. . | |
| 4,591,190 | 5/1986 | Clark . | |
| 4,671,512 | 6/1987 | Bachman et al. . | |
| 4,677,553 | 6/1987 | Roberts et al. . | |
| 4,708,369 | 11/1987 | Greig . | |
| 4,725,079 | 2/1988 | Koza et al. . | |
| 4,726,608 | 2/1988 | Walton . | |
| 4,738,473 | 4/1988 | Meloni et al. . | |
| 4,850,618 | 7/1989 | Halladay, Jr. | 283/94 |
| 4,858,123 | 8/1989 | Alexoff et al. . | |
| 5,074,566 | 12/1991 | Desbiens . | |
| 5,228,692 | 7/1993 | Carrick et al. | 273/139 |

FOREIGN PATENT DOCUMENTS

| | | |
|---|---|---|
| WO8707846 | 12/1987 | PCT Int'l Appl. . |
| 2075918A | 11/1981 | United Kingdom . |

*Primary Examiner*—Paul A. Bell
*Attorney, Agent, or Firm*—Michael B. McMurry

[57] ABSTRACT

Security of game cards such as instant lottery tickets can be improved by locating a confusion pattern below a primer layer on the game cards substrate and by locating another confusion pattern on a release coat above the game card play indica. Game card security can be further enhanced by using confusion pattern ink that bleeds through the game card in response to the application of various solvents.

52 Claims, 2 Drawing Sheets

GAME TICKET CONFUSION PATTERNS

This application is a continuation-in-part of application Ser. No. 07/879,827 filed May 7, 1992, now abandoned.

FIELD OF THE INVENTION

The invention relates to the field of game tickets and in particular to security features in instant type game or lottery tickets.

BACKGROUND OF THE INVENTION

Game cards such as lottery tickets and promotional game cards typically contain hidden play indicia such as numbers, symbols or messages that indicate whether or not the card is a winner or has a certain value to the player. The play indicia is normally covered by a opaque coating material for example a latex compound which can be scratched off by the player to reveal the play indicia after the ticket has been purchased or otherwise obtained by the player. Examples of various game card and instant lottery ticket construction are disclosed in U.S. Pat. Nos. 4,174,857, 4,273,362, 4,299,637, 4,725,079 and 4,726,608.

Of paramount importance to the game card industry and in particular the instant lottery industry is security. One method of breaching the security of game tickets is by candling. Here a bright light is applied to the game card in an effort to read the play indicia either through the latex covering or the back of the ticket. A number of techniques have been developed to counter candling including the use of a foil layer such as aluminum foil as part of the game ticket. This foil layer blocks visible light and therefore makes it virtually impossible to read the play indicia through the opaque coating. However the use of a foil layer has a number of significant disadvantages including the expense of an extra process step to add the foil layer to the card or ticket as well as the cost of the foil itself. Also with the increased emphasis on recycling, aluminum foil can present problems and costs to game card manufacturers along with the users of game cards such as state lottery administrations. For example used lottery tickets must be collected from the public and then the foil has to be separated from the rest of the ticket before it can be recycled.

A second approach to prevent candling is to imprint confusion patterns on the ticket. A confusion pattern obscures or otherwise confuses the image of the play indicia when visible light is shined through the game card thus making it difficult or impossible to read the indicia before the latex covering is removed. In one example illustrated in U.S. Pat. No. 3,900,219, a confusion pattern is printed on the back of a lottery ticket. Although confusion patterns printed on the back of the ticket help to prevent candling, other methods exist for compromising the security of the ticket. For example, delamination can be used to overcome the security provided by confusion patterns printed on the back of the ticket. The back ticket layer containing the confusion layer is separated or delaminated from the ticket. Once delaminated, the indicia can be read by candling. Confusion patterns consisting of irregular opaque areas have also been printed on the top surface of the card stock below the opaque mask. Another technique is described in U.S. Pat. Nos. 4,095,824 and 4,241,942. In this case, to prevent photocopying through the opaque mask, a confusion pattern is printed over the play indicia using a transparent media or a media having a color differing from the color of the play indicia so that the confusion pattern will not obscure the play indicia when the opaque mask is removed by a player. Another confusion pattern is then printed below the play indicia on the card material immediately below the play indicia. One disadvantage of this approach is that unless the upper confusion pattern is completely transparent its existence will be apparent to those individuals who may be considering methods for breaching game card security. In addition the upper confusion pattern as described makes very little contribution to the prevention of candling.

Wicking is another technique that has been used to read the play indicia without having to remove the opaque mask. In wicking a solvent containing alcohols, ketones, acetate, esters, alaphtic or amine solutions is applied to either the back or the front of the game card resulting in the bleed through of an image of the play indicia. This makes it possible to determine if a game card is a winner before the opaque coating is removed. One approach to prevent wicking to place solvent responsive dyes in the opaque coating as described in U.S. Pat. No. 4,726,608. This is a relatively expensive process however. Confusion patterns, as described above, have not generally been effective in countering wicking.

SUMMARY OF THE INVENTION

It is, therefore, an object of the invention to reduce the cost and to enhance the security of game cards by the use of particular locations and characteristics of confusion patterns.

It is another object of the invention to provide a game ticket which is secure against delamination.

It is a further object of the invention to provide a secure game ticket which does not have substantially all of its back surface covered with a confusion pattern and therefor has substantially all of its back surface available for display purposes.

It is another object of the invention to provide a game card having a removable opaque coating covering a set of play indicia with a confusion pattern located above the play indicia such that the confusion pattern is also removed when the opaque coating is removed by a player.

It is also an object of the invention to provide a game card having a removable opaque coating covering a set of play indicia with a confusion pattern that bleeds in the presence of a solvent that also causes the hidden play indicia to bleed.

It is an additional object of the invention to provide a game card having a removable opaque coating covering a set of play indicia and a confusion pattern which is removed with the removable opaque layer.

It is a further object of the invention to provide a game card having a card substrate where a confusion pattern is printed with an ink, that bleeds in the presence of one or more solvents where the same solvents also cause bleeding of the hidden play indicia, on the upper surface of the substrate and below a set of play indicia which in turn is covered by a removable opaque coating. Security can be further enhanced by providing a second confusion pattern printed on a release coat that covers the play indicia.

DETAILED DESCRIPTION OF THE INVENTION

Figure 1:
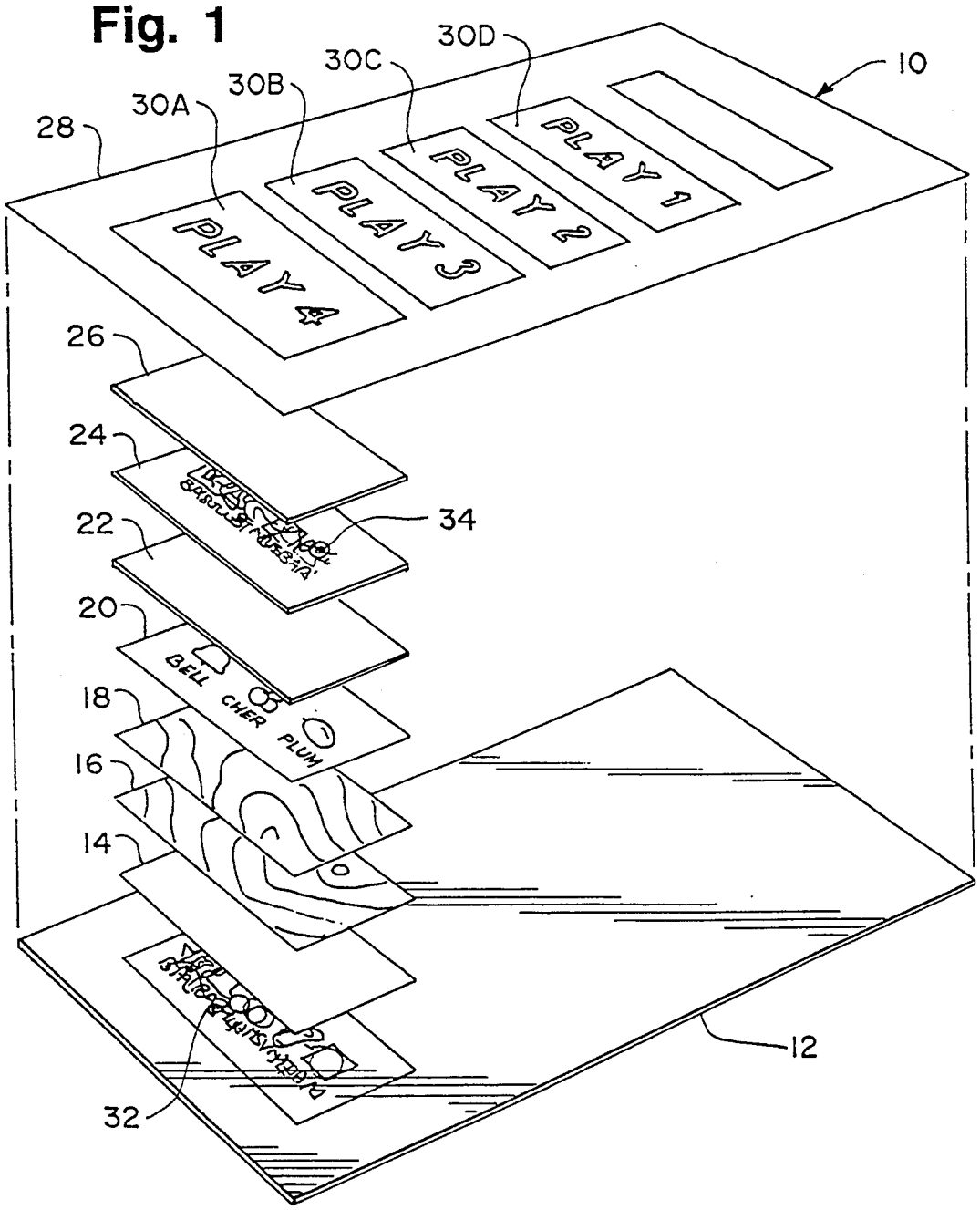
FIG. 1 is an exploded perspective view of a game card employing confusion patterns of the invention.

FIG. 1 shows in exploded form a representative example of the construction of a game card 10 which illustrates a preferred embodiment of the invention. For clarity only a portion of the various internal layers of the card 10 are shown in FIG. 1. The first layer of the card 10 is a substrate 12 preferably composed of paper. A primer layer 14 is applied to the substrate 12 and then a blue along with a red benday pattern 16 and 18 are printed on the substrate primer 14. The purpose of the benday patterns 16 and 18 is to detect vertical ticket splitting. On top of the benday patterns 16 and 18 a set of play indicia 20 is printed which in the example of FIG. 1 includes a bell, a cherry and a plum. To protect the play indicia 20 a seal coat 22 is applied over the play indicia 20 and then a release coat 24 is applied on top of the seal coat 22. In order to prevent visual observation of the play indicia 20 a removable opaque mask or coating 26 is applied to the release coating 24. Coating 26 is preferably an elastomeric substance, such as latex. An overprint layer 28 which can include game information such as a set of game play indicators 30A–D forms the top most layer of the game ticket 10. A more detailed description of the basic components of the game ticket 10 is provided in U.S. Pat. No. 4,726,608.

Figure 3:
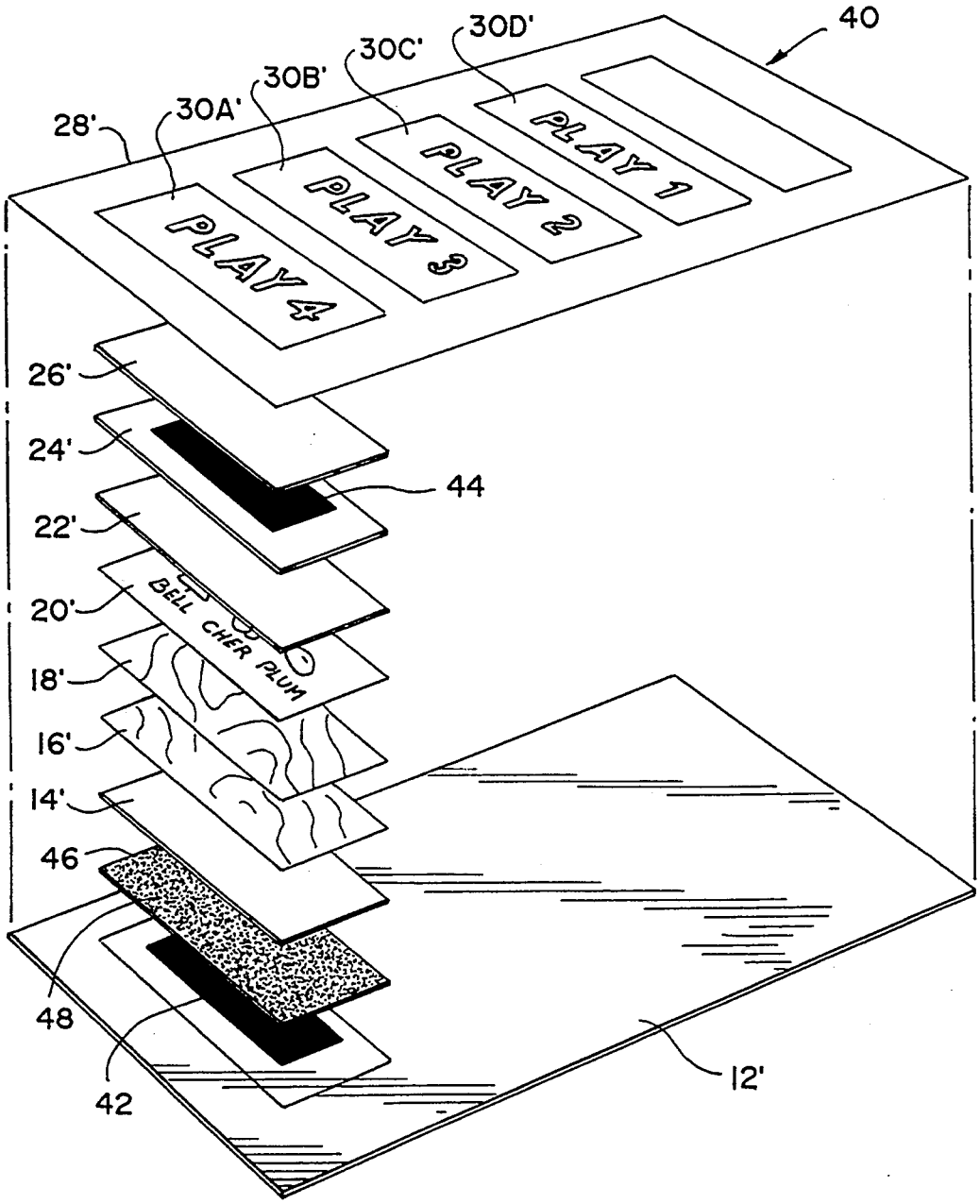
FIG. 3 is an exploded view of an alternative embodiment of a game card employing a substantially opaque permanent confusion pattern according to the invention.

In the embodiment of the invention shown in FIG. 1, candling can be inhibited by a permanent confusion pattern 32 printed on the substrate 12 underneath the primer coating 14 and a removable confusion pattern 34 printed on the top of the release coat 24 beneath the removable coating 26. By locating the permanent confusion pattern below the primer layer 14 visual interference with the play indicia 20 is avoided and the existence of this confusion pattern 32 is not readily apparent to the public. In some instances it may be desirable to print an uniform opaque coating such as gray or black ink or a color matching the play indicia 20 below the primer layer 14 instead of the confusion pattern 32. An opaque uniform coating 42 is illustrated in FIG. 3 and is described in more detail with reference thereto. The removable confusion pattern 34 can be a uniform opaque coating as well and can be printed in black or gray ink or in a color matching the play indicia 20. Since the removable confusion pattern 34 is located between the removable coating 26 and the release coat 24 it will be removed when the opaque mask 24 is scratched off by a player. Thus this confusion pattern 34 will likewise not interfere with the observation of the play indicia 20 when the mask 26 has been removed by the player nor will its existence be apparent to the public.

To further enhance the security of the game card 10, one or both of the confusion patterns 32 and 34 can be printed with an ink that include visible materials that go into solution or dispersion when they come in contact with various solvents such as alcohols, ketones, acetate, esters, alaphtics or amine solutions that are typically used in wicking. In this manner breaching the security of the game card 10 by wicking can be prevented because the confusion patterns 32 and 34 will tend to bleed through the ticket with the play indicia 20 making the play indicia 20 indiscernible. Another advantage of using a solvent responsive ink in the removable confusion pattern 34 is that in some cases it eliminates the need to use dyes in the removable mask 26 to prevent wicking. This object can be achieved by incorporating solvent responsive dyes into the confusion pattern ink.

Preferably the confusion pattern inks 32 and 34 should have the same bleed characteristics as the play indicia ink 20 in order to inhibit wicking. For example, if the play indicia 20 is not subject to bleeding then the confusion pattern inks should not be subject to bleeding.

A suitable confusion pattern ink for use with play indicia 20 that have the color black would include a gray or black grind base. Ink having a 16% gray or black ink grind base by weight component along with 16% by weight methyl ethyl ketone; 6% by weight K-1717B resins; 10% by weight pentalyn 255 resin; 8% by weight DM-55 acrylic resin and 16W6 N/C white base components will bleed on contact with solvents containing ammonia or other amines as well as alcohols. Depending upon the type and color of ink used for the play indicia 20, other types of dyes that will form a solution or dispersions with the solvents can be used for the confusion pattern ink including inks of different colors than black or gray. It is also desirable that the solvent responsive dye match the color of the play indicia ink. The density of the dye should match the density of the play indicia ink as well otherwise it may be possible to read the play indicia 20 through the confusion patterns 32 and 34.

Figure 2:
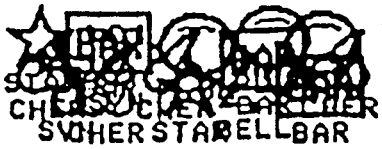
FIG. 2 is a plan view of a confusion pattern for use with the game card of FIG. 1.

The preferred form of the confusion patterns 32 and 34 is a random series of portions of the symbols used in the play indicia 20 having the same line weight. An example of such a confusion pattern is provided in FIG. 2. The confusion pattern 32 should also have the same general printing characteristics as the play indicia 20, to increase the apparent similarity between the confusion pattern 32 and the play indicia 20. For example, if the play indicia 20 are printed as groupings of small dots, as is the result with ink jet printers, the confusion pattern 32 should also be printed as groupings of small dots. It may also be desirable to vary the print characteristics of the play indicia 20 and the confusion pattern 32. For example, it may be desirable to print the individual symbols in the play indicia 20 with different print densities and line weights. The individual symbols or portions of the confusion pattern 32 would then also be printed using varied characteristics. Printing the confusion pattern 32 and the play indicia 20 with varying characteristics helps to overcome difficulties in matching the specific characteristics, such as print density, of the play indicia 20 and the confusion pattern 32 and thus increases the apparent similarity between the play indicia 20 and the confusion pattern 32. However, as indicated above, a uniform coating of, for example, black ink, can be used instead of one or the other or even both of the confusion patterns 32 and 34.

In the preferred embodiment of the invention the confusion patterns 32 and 34 are printed with ink that provide the same general appearance as the play indicia when the game card 10 is candled. In some cases due to materials used in constructing the card 10, it is possible that the confusion patterns 32 and 34 may have to be of a different color or print type in order to match the play indicia 10 when candled.

FIG. 3 shows in exploded form a representative example of an alternative embodiment of a game card 40 in accordance with the invention. The elements of card 40 which are analogous to those of card 10 are referenced using primed numbers. Card 40 includes a substrate 12', preferably composed of paper, and a primer layer 14' applied to the substrate. Blue and red benday patterns 16' and 18' are printed on the primer 14' and provide detection of vertical ticket splitting. Play indicia 20', such as a bell or plum, are printed on top of the benday patterns 16', 18' and are in turn overprinted with a seal coat 22' and a release coat 24'. A removable opaque layer 26' applied over the release coat 24' prevents premature visual detection of the play indicia 20'. The seal coat 22' and release coat 24' protect the play indicia 20' when the opaque mask 26' is removed by the ticket holder. Game information such as a set of game play indicators 30A'–D' are applied as an overprint layer 28' and form the top most layer of the game ticket 24.

Game ticket 40 has three features which differ from game ticket 10. First, a permanent uniform opaque confusion pattern 42 is printed on the substrate 12' instead of the permanent patterned confusion layer 32 shown in FIGS. 1 and 2. Second, the removeable confusion pattern 44 is printed as a solid layer instead of the patterned layer shown in FIG. 1. Third, game ticket 40 has an additional blocking layer 46 which is applied over the confusion pattern 42 beneath the benday patterns 16' and 18'.

Like confusion pattern 32 of ticket 10, opaque confusion pattern 42 prevents detection of the play indicia 20' by candling. Opaque confusion pattern 42 can be printed using a black or gray ink. Alternatively, a colored ink which matches the color of the play indicia 20' could be used. A suitable ink formulation for opaque confusion pattern 42 includes, on a percent by weight basis, 25% Predasol carbon black 1649-V, available from KVK USA, Inc., 10% VCMA (a maleic acid copolymer of vinyl acetate) available from Union Carbide, and 65% methyl-ethyl ketone. Another suitable formulation for the ink used to print opaque confusion pattern 42 includes, on a percent by weight basis, 24.54% Predasol carbon black 1615-PA available from KVK USA, Inc., 24.54% versamide 940 resin (a polyamide resin) available from Hinkel, 25.46% ethanol, and 25.46% heptane. If desired, a dye grind base can be added to these formulations. Opaque confusion pattern 42 helps to overcome difficulties in matching the specific characteristics, such as print density, of the play indicia 20' and the opaque confusion pattern 32.

Blocking layer 46 is applied over opaque confusion pattern 42 beneath benday layers 16' and 18'. Blocking layer 46 increases the apparent opacity of primer layer 14' thereby preventing visual interference from the confusion pattern 42 when the ticket holder inspects the play indicia 20'. Blocking layer 46 could also be used with the patterned confusion pattern 32 of ticket 10 if desired. Alternatively, a sufficiently opaque primer layer 14 or 14' could be used without a blocking layer 46. A sufficiently opaque primer layer could include, for example, pigments including metallic-based substances such as Aluminum or titanium dioxide.

A suitable formulation for blocking layer 46 includes, on a percent by weight basis, 33.33% Predasol rutile white 1300-PA (a polyamide resin containing titanium dioxide) available from KVK USA, Inc., 22.22% versamide 940 resin, 22.225 ethanol, and 22.225 heptane. An alternate formulation for blocking layer 46 includes, on a percent by weight basis, 19.62% normal propyl acetate, 12.46% acryloid DM 55 (an acrylic resin), 8.96% pentalyn 830 resin, 8.96 Pierce Stevens 1402 nitro cellulose, 40% Thiele Engdahl W200 nitro cellulose white dispersion and 10% aluminum paste 40XD, available from Reynolds. The amount of Aluminum paste used can be varied from 1% to 10% with appropriate correction of the amounts of the other constituents. The titanium dioxide or the Aluminum is graphically represented in FIG. 3 as particles 48 dispersed throughout blocking layer 46. Both the titanium dioxide formulation and the Aluminum formulation are applied to ticket 40 by a rotogravure process. Blocking layer 46 could also be applied by other printing processes such as silk screening, offset printing or flexographic printing. However, the exact composition of the formulation including the type of solvent used may vary for different printing processes.

The use of either the permanent confusion patterns 32 or 42, or the removable confusion pattern 34 or 44 or a combination of both in the game cards 10 and 40 can substantially improve game card security while at the same time decrease the costs of manufacturing the cards. Additional security is provided by using solvent responsive inks for the confusion patterns 32, 34, 42, and 44 as described above. Blocking layer 46 improves the appearance and the desirability of game cards using confusion patterns 32 or 42. As a result the invention, as described above, now makes it possible to produce relatively inexpensive paper game cards having a high degree of security.

We claim:

1. A game card comprising:

a card substrate having an upper surface and a lower surface;

a play indicia affixed to said upper surface of said card substrate;

a removable elastomeric coating secured to said upper surface of said card substrate over said play indicia; and a removable confusion pattern interposed between said removable coating and said play indicia wherein said removable confusion pattern is removed when said removable coating is removed.

2. The card of claim 1 wherein a release coat is interposed between said play indicia and said removable coating and wherein said removable confusion pattern is located on said release coat.

3. The card of claim 2 wherein said removable confusion pattern is printed on the upper surface of said release coat.

4. The card of claim 1 wherein said removable confusion pattern is printed with an ink that provides substantially the same appearance as said play indicia when the card is candled.

5. The card of claim 1 wherein said removable confusion pattern has substantially the same print characteristics as said play indicia.

6. The card of claim 1 wherein said removable confusion pattern is printed with an ink which is substantially the same color as the ink used to print said play indicia.

7. The card of claim 1 wherein said removable confusion pattern is printed with an ink that provides substantially the same appearance as said play indicia when the card is candled.

8. The card of claim 1 wherein said removable confusion pattern is a uniform opaque coating.

9. The card of claim 8 wherein said removable confusion pattern is printed with an ink which is substantially the same color as the ink used to print said play indicia.

10. The card of claim 1 wherein said removable confusion patterns is printed in an ink having substantially the same bleed characteristics as said play indicia.

11. The card of claim 1 wherein said removable confusion pattern is printed with an ink including visible materials which form a solution or a dispersion with at least one solvent.

12. The card of claim 11 wherein said play indicia are printed with an ink including visible material which form a solution or a dispersion with at least one solvent.

13. The card of claim 11 wherein said visible materials are the same color as said play indicia.

14. The card of claim 13 wherein said solvents include alcohols, ketones, acetate, esters, alaphtics or amine solutions.

15. The card of claim 11 wherein said confusion pattern ink has substantially the same density as said play indicia.

16. The card of claim 11 wherein said play indicia are printed with varying ink densities.

17. The card of claim 16 wherein said confusion pattern is printed with varying ink densities.

18. The card of claim 16 wherein said ink includes a gray or black grind base.

19. The card of claim 17 wherein said ink is substantially the same color as the ink of the play indicia.

20. The card of claim 1 additionally including a permanent confusion pattern interposed between said play indicia and said upper surface of said card substrate.

21. The card of claim 20 wherein said permanent confusion pattern is printed with an ink including visible materials which form a solution or a dispersion with at least one solvent.

22. The card of claim 21 wherein said visible materials are the same color as said play indicia.

23. The card of claim 22 wherein said removable confusion pattern has substantially the same print characteristics as said play indicia.

24. The card of claim 22 wherein said removable confusion pattern is printed with an ink that provides substantially the same appearance as said play indicia when the card is candled.

25. The card of claim 21 wherein said solvents include alcohols, ketones, acetate, esters, alaphtics or amine solutions.

26. The card of claim 21 wherein said ink includes a gray or black grind base.

27. The card of claim 20 additionally including an opaque primer layer interposed between said permanent confusion pattern and said play indicia.

28. The card of claim 27 wherein said permanent confusion pattern is printed on said upper surface of said card substrate.

29. The card of claim 20 wherein said permanent confusion pattern is printed with an ink having substantially the same density as said play indicia.

30. The card of claim 20 wherein said permanent confusion pattern is a uniform opaque coating.

31. The card of claim 1 wherein said removable confusion pattern is printed with an ink having substantially the same density as said play indicia.

32. The card of claim 31 wherein said play indicia are printed with varying ink densities.

33. The card of claim 32 wherein said confusion pattern is printed with varying ink densities.

34. A game card comprising:

a card substrate having an upper surface and a lower surface;

a play indicia affixed to said upper surface of said card substrate;

a removable coating secured to said upper surface of said card substrate over said play indicia;

a permanent confusion pattern interposed between said play indicia and said upper surface of said card substrate wherein said permanent confusion pattern includes a substantially opaque ink: and a removable confusion pattern interposed between said play indicia and said removable coating wherein said removable confusion pattern is removed when said removable coating is removed.

35. The card of claim 34 wherein said permanent confusion pattern is printed in an ink having substantially the same bleed characteristics as said play indicia.

36. The card of claim 35 wherein said ink includes a gray or black grind base.

37. The card of claim 34 wherein said substantially opaque ink includes visible materials which form a solution or dispersion with one or more solvents.

38. The card of claim 37 wherein said solvents include alcohols, ketones, acetate, esters, alaphtics or amine solutions.

39. The card of claim 34 wherein said permanent confusion pattern is a uniform opaque coating.

40. The card of claim 34 wherein said substantially opaque ink includes visible materials having the same color as said play indicia.

41. The card of claim 34 additionally including a primer material interposed between said permanent confusion pattern and said play indicia.

42. The card of claim 41 wherein said confusion pattern is printed on said upper surface of said card substrate.

43. The card of claim 42 wherein said substantially opaque ink includes visible materials having the same color as said play indicia.

44. A game card comprising:

a card substrate having an upper surface and a lower surface;

a play indicia affixed to said upper surface of said card substrate;

a removable coating secured to said upper surface of said card substrate over said play indicia;

a permanent confusion pattern interposed between said play indicia and said upper surface of said card substrate wherein said permanent confusion pattern includes a substantially opaque ink;

a blocking layer interposed between said play indicia and said permanent confusion pattern: and a removable confusion pattern interposed between said play indicia and said removable coating wherein said removable confusion pattern is removed when said removable coating is removed.

45. The card of claim 44 wherein said permanent confusion pattern is a uniform opaque coating.

46. The card of claim 44 where said substantially opaque ink includes carbon black.

47. The card of claim 44 wherein said substantially opaque ink is the same color as said play indicia.

48. The card of claim 44 further including a primer material interposed between said blocking layer and said play indicia.

49. A game card comprising:

a card substrate having an upper surface and a lower surface;

a play indicia affixed to said upper surface of said card substrate;

a removable coating secured to said upper surface of said card substrate over said play indicia:

a permanent confusion pattern interposed between said play indicia and said upper surface of said card substrate wherein said permanent confusion pattern is a substantially uniform opaque printed layer: and a removable confusion pattern interposed between said removable coating and said play indicia.

50. The card of claim 49 wherein said removable confusion pattern is a substantially opaque printed layer.

51. The card of claim 49 wherein said permanent confusion pattern includes carbon black.

52. A game card comprising:

a card substrate having an upper surface and a lower surface;

a play indicia affixed to said upper surface of said card substrate;

a removable coating secured to said upper surface of said card substrate over said play indicia;

a first substantially solid opaque confusion pattern interposed between said upper surface of said card substrate and said play indicia; and a second substantially solid opaque removable confusion pattern interposed between said play indicia and said removable elastomeric coating wherein said removable confusion pattern is removed when said removable coating is removed, wherein said first and second confusion patterns are printed layers.

* * * * *